United States Patent [19]

Laurich-Trost

[11] 4,436,183

[45] Mar. 13, 1984

[54] MATERIAL HANDLING APPARATUS

[76] Inventor: Victor R. Laurich-Trost, 34600 McAfee Dr., Solon, Ohio 44139

[21] Appl. No.: 302,515

[22] Filed: Sep. 18, 1981

[51] Int. Cl.[3] ..... B66B 11/04

[52] U.S. Cl. ..... 187/9 E; 182/14; 182/148

[58] Field of Search ..... 187/9 E; 182/148, 141, 182/14, 13, 12; 180/21, 236

[56] References Cited

U.S. PATENT DOCUMENTS

| | | | |
|---|---|---|---|
| 3,757,899 | 9/1973 | Smith | 187/9 E |
| 3,782,503 | 1/1974 | Sinclair | 187/9 E |
| 3,788,444 | 1/1974 | McWilliams | 180/6.48 X |
| 4,261,438 | 4/1981 | Olson | 180/9 E |

*Primary Examiner*—Joseph J. Rolla
*Assistant Examiner*—Thomas Fitzgerald
*Attorney, Agent, or Firm*—Watts, Hoffmann, Fisher & Heinke Co.

[57] ABSTRACT

A lift apparatus for use in material handling characterized by a self-propelled and steerable chassis which mounts a pair of laterally spaced multi-stage mast assemblies for raising and lowering a lift carriage, and a stabilization torsion bar system actuatable by the mast assemblies for maintaining the lift carriage in a horizontal plane during such operation.

5 Claims, 14 Drawing Figures

MATERIAL HANDLING APPARATUS

DESCRIPTION

TECHNICAL FIELD

The present invention relates to a material handling apparatus, and more particularly relates to what is termed a high order picker which is a truck or vehicle for use in material handling applications for lifting and transporting items such as in warehousing or the like.

BACKGROUND ART

More specifically, the apparatus of the invention relates to a truck or vehicle especially suited for dock and warehouse use which embodies a self-propelled truck or vehicle including a movable platform carriage assembly actuatable for lifting movement in a vertical direction by means of a pair of oppositely disposed triple-stage mast assemblies. The lift carriage and mast assemblies are mounted on a chassis having a drive and multi-mode steering capability to enable the vehicle to be turned at an angle from 0° to 90° in either direction by operation from an operator's cab mounted on and for movement with the carriage lift platform assembly. The vehicle further incorporates a stabilizing torque bar assembly operably associated with the mast assemblies for automatically and synchronously leveling action on the lift platform carriage assembly during raising and lowering thereof.

Prior material handling or lift apparatus of a different type but generally related to the subject matter of the present invention are described, for example, in U.S. Pat. Nos. 2,816,675 and 3,414,487.

DISCLOSURE OF THE INVENTION

The present invention relates to a material handling apparatus embodied in the form of a self-propelled lift truck or vehicle for expanding the flexibility and utility of the material handling function and hence, the effectiveness of the vehicle as compared to conventionally powered material handling apparatus, such as fork lift trucks or the like. Specifically, in the invention there is provided a material handling apparatus which incorporates a movable lift carriage assembly mounted for verticle raising and lowering movement on a chassis by means of a pair of laterally spaced, oppositely disposed hydraulic triple-stage mast assemblies. A stabilizing torque bar assembly is operably associated with the mast assemblies and with the lift carriage assembly for automatically and synchronously maintaining a leveling action on the lift carriage assembly during its raising and lowering movement upon actuation of the hydraulic mast assemblies. In the invention, the chassis incorporates a pair of front wheels and a pair of rear wheels with the front wheels being mechanically interconnected by a first chain drive and said rear wheels being mechanically interconnected by a second chain drive for synchronous turning movement to provide a multi-mode steering capability from 0° through 90° in either direction, as well as in linear forward and rearward directions.

Accordingly, the present invention provides a unique material handling or lift apparatus which is relatively economical to fabricate, efficient to utilize and which can handle relatively bulky and/or heavy loads at relatively large heights especially in warehouse applications where the available aisle area imposes severe space limitations. For example, the present invention has especially good usage in warehouse applications where the aisles are relatively close together and are relatively long and narrow presenting serious space problems with conventional type lift trucks that have only a single fork-lift capability and/or have limited turning capability. In addition, the present invention provides a truck or vehicle which has good strength and stability characteristics for raising and lowering relatively heavy and/or bulky loads to relatively substantial heights. Accordingly, in the present invention there is provided a novel material handling or lift apparatus that provides a synchronized and level lifting function so as to maintain good load balance for a wide variety of applications.

BEST MODE FOR CARRYING OUT THE INVENTION

Figure 1:
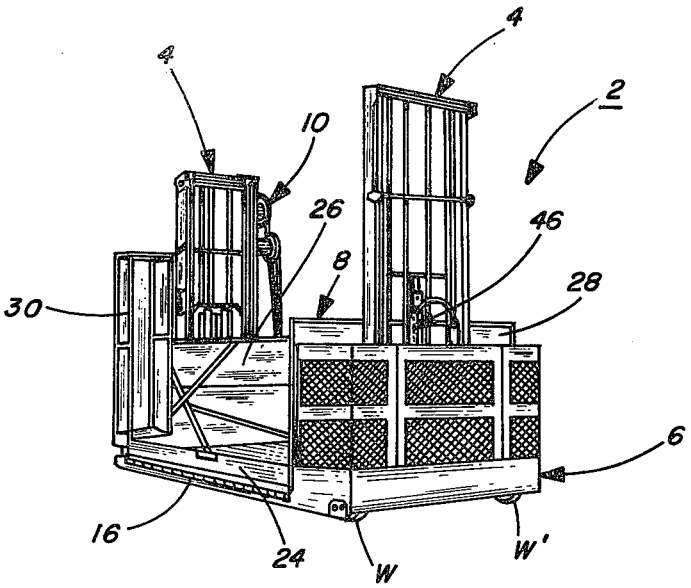
FIG. 1 is a generally perspective view illustrating the lift apparatus of the present invention in the lowered position.
Figure 2:
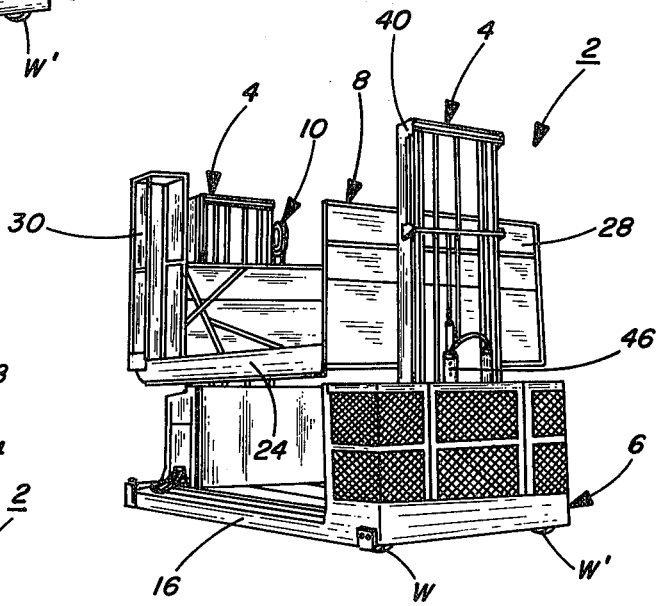
FIG. 2 is a generally perspective view illustrating the lift apparatus in a partially raised position.
Figure 3:
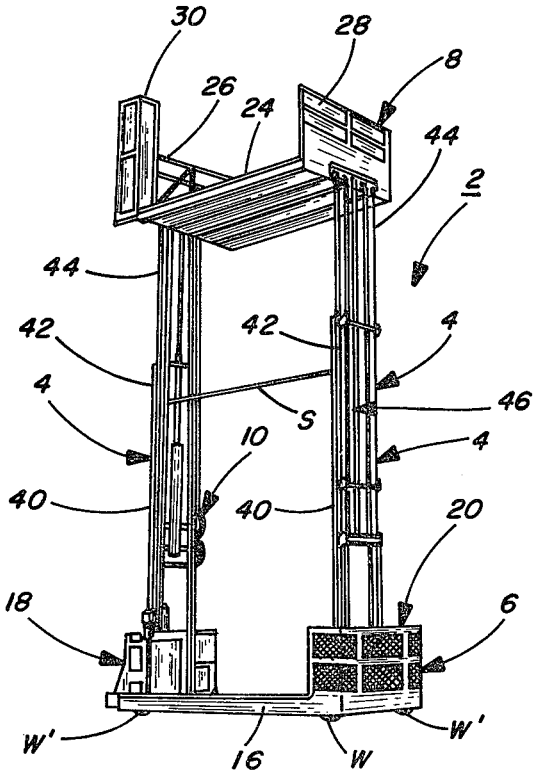
FIG. 3 is a generally perspective view illustrating the lift apparatus of the invention in the fully raised position.
Figure 4:
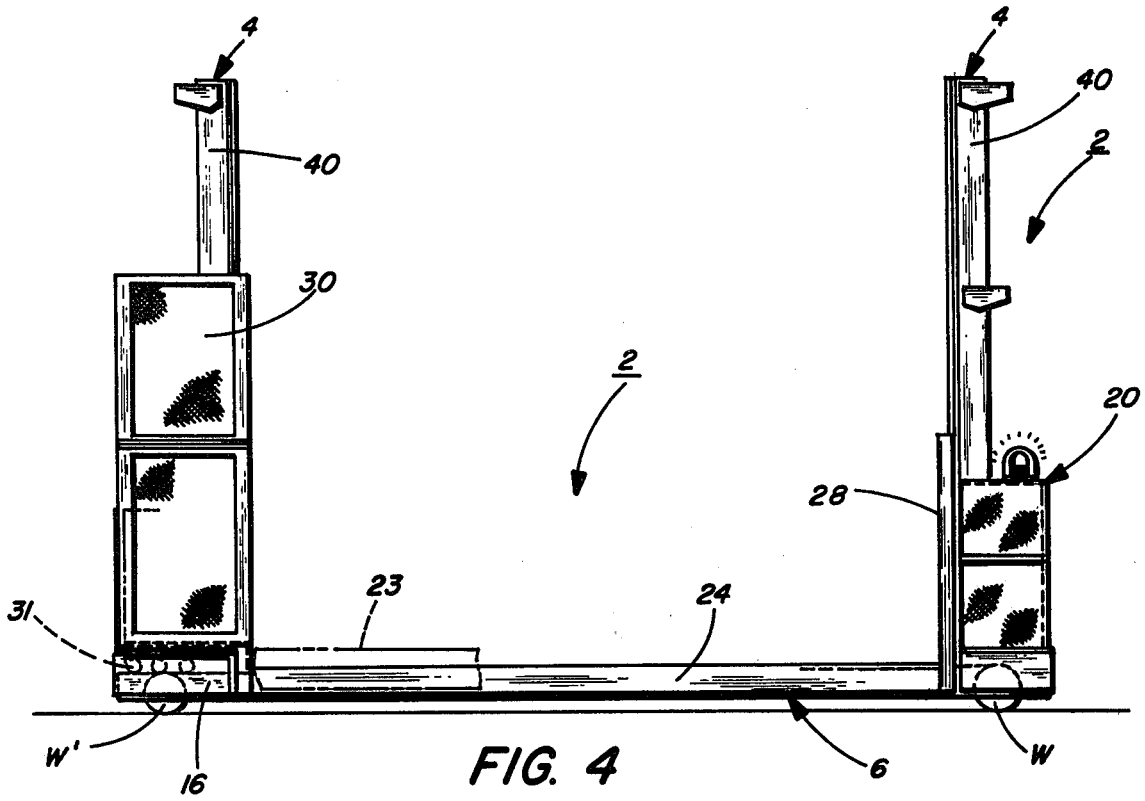
FIG. 4 is a side elevation view of the lift apparatus made in accordance with the invention.

Now referring again to the drawings and in particular to FIGS. 1 through 3, there is illustrated the lift apparatus, designated at 2, made in accordance with the invention. As illustrated, the lift apparatus 2 embodies a high rider order picker truck which incorporates two triple-stage roller mast assemblies which are mechanically and hydraulically synchronized for level platform operation during all stages of the usage thereof. The mast assemblies, designated generally at 4, are of an identical construction disposed at opposed ends of the vehicle chassis, designated generally at 6. This dual mast assembly mounts a lift platform assembly, designated generally at 8, which is raised and lowered in a vertical direction by the dual mast assemblies 4. The lift platform assembly 8 is maintained in a level position at all time by means of a lift platform stabilizing assemblies 83 and 85 (FIGS. 12 and 13), which coact between the dual mast and lift platform assemblies 4 and 8. In the invention, the chassis 6 is mounted on wheels which are controllable by a multi-mode steering system in accordance with the invention. The vehicle is operable for hydraulic forward, reverse and variable speed drive which may be controlled by a joy stick control in the operator's cab. Take-up sheaves 10 on the carriage and mast assemblies allows movement of the carriage relative to the chassis.

Now in the invention, the chassis 6 includes a horizontal base member 16 which is mounted on the multi-mode steering wheel system of the invention. The base 16 mounts at one end a battery unit, designated generally at 18, which provides the motor drive source for the hydraulic control system. At the other end, the base mounts the hydraulic motor unit, designated generally at 20, for controlling the dual mast assembly mounted on the base member 16. Accordingly, the base member 16 mounts at opposed ends of the dual mast assemblies 4.

Figure 5:
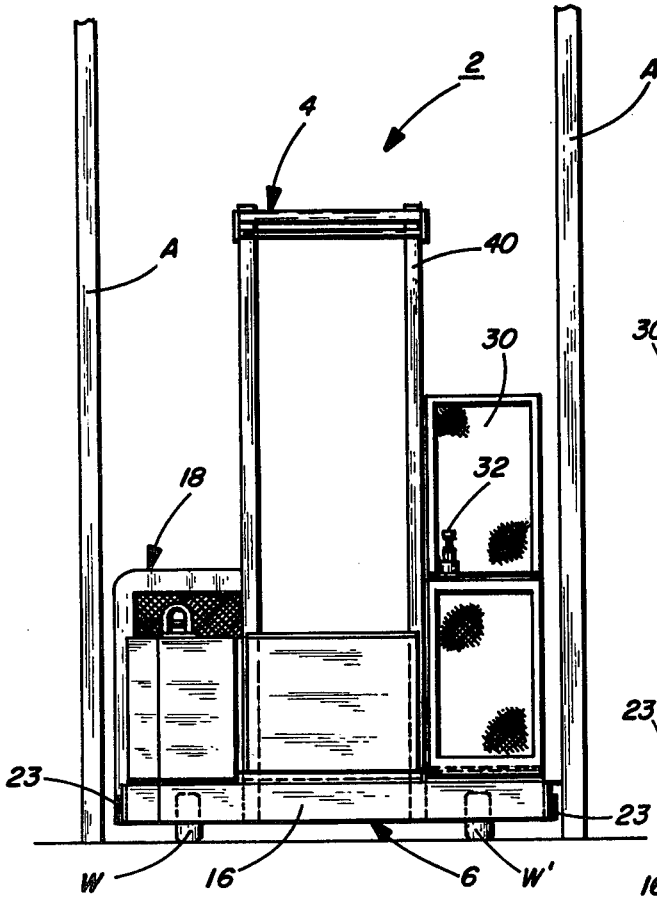
FIG. 5 is a fragmentary, front elevation view looking from the left-hand side of FIG. 4.
Figure 6:
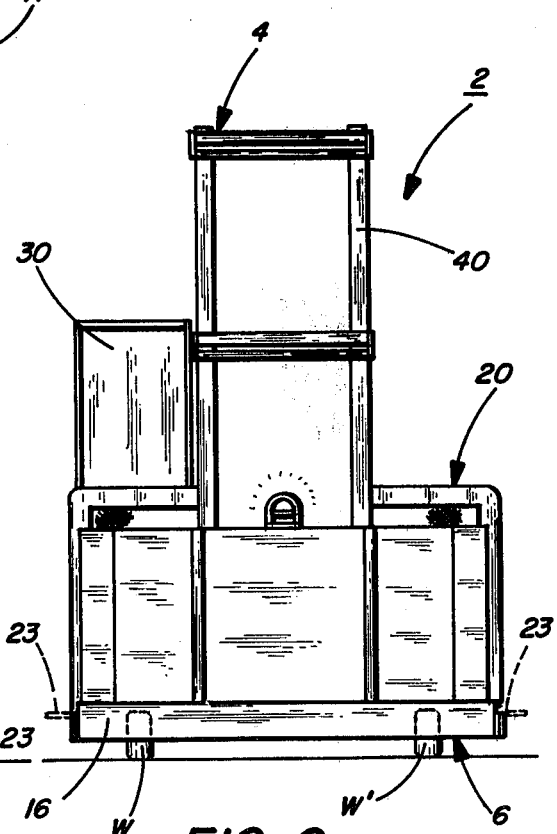
FIG. 6 is a rear end elevation view looking from the right-hand side of FIG. 4.
Figure 7:
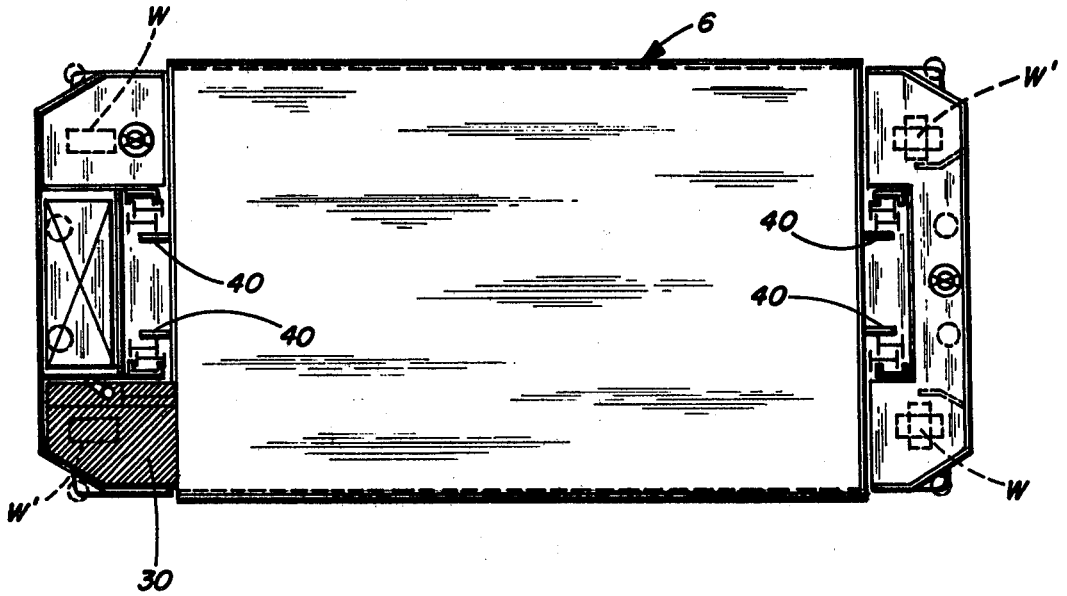
FIG. 7 is a top plan view looking down on the lift apparatus of FIG. 4.

In the embodiment illustrated, the dual mast assemblies 4 mount the lift platform assembly 8 which includes a lift platform 24 which includes an integral pair of end side walls (FIG. 3) illustrated at 26 and 28. On one end of the lift platform 24 is provided an operator's cab, designated generally at 30, for driving and steering the lift apparatus. As best illustrated in FIG. 5, the operator's cab 30 includes a joy stick control 32 for driving and steering the lift apparatus in accordance with the invention. Accordingly, by this arrangement the operator's cab 30 is mounted on the lift platform member 24 for raising and lowering upon actuation of the dual mast assembly, as best illustrated in FIGS. 1 through 3 thereof.

Figure 8:
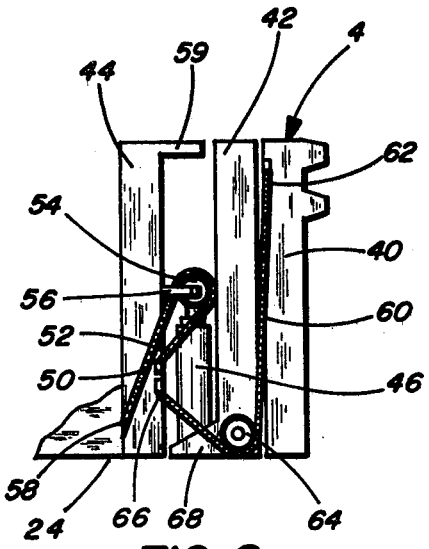
FIG. 8 is a generally schematic illustration illustrating one of the mast assemblies in the fully lowered position.
Figure 9:
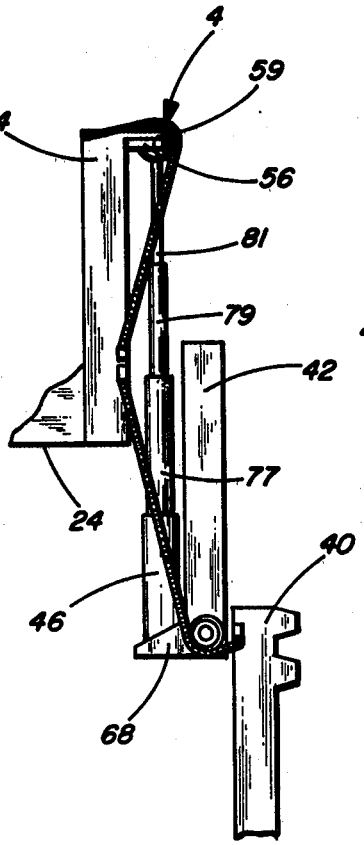
FIG. 9 is a fragmentary, diagrammatical illustration illustrating the mast assembly in the fully extended position.
Figure 10:
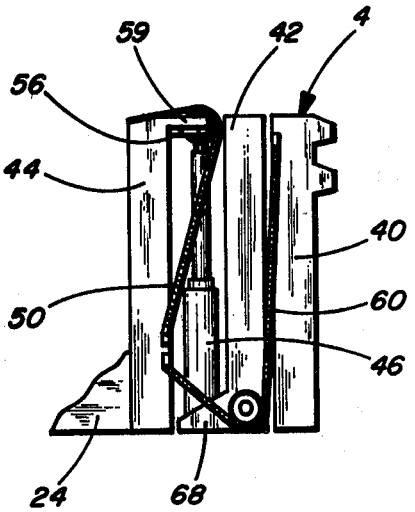
FIG. 10 is a diagramatic illustration showing the mast assembly in the free-lift position.

In FIGS. 8 through 10 there is illustrated operation of one of the dual mast assemblies. In FIG. 8, the mast assembly is illustrated in the fully lowered position, in FIG. 9 in the fully extended position, and in FIG. 10 in a free-lift position. As shown, each mast assembly includes an outer upright assembly 40 mounted on the vehicle chassis 6. An intermediate upright assembly 42 telescopes within the outer upright assembly 40 and an inner upright assembly 44 telescopes within the intermediate upright assembly 42. A hydraulic hoist cylinder 46 is mounted on a cradle 68 which is made integral with the lower end of the intermediate upright assembly 42. A pair of carriage chains 50 (only one shown) are fixed to the inner upright assembly 44, as at 52. The chains 50 are looped around upper sheaves 54 with the sheaves being attached to a cross-head member 56 that is attached to the top of the hoist cylinder 46. The other ends of the carriage chains are fixedly attached, as at 58, to the bottom of the lift platform member 24. A pair of boot straps chains 60 (only one shown) are fixed to the top of the outer upright assembly 40, as at 62. These chains are looped around the intermediate upright sheaves 64 which are mounted at the lower end of the intermediate upright assembly 42. The other ends of the chains are fixedly attached to the inner upright assembly 44, as at 66.

In the fully extended position illustrated in FIG. 9, raising of the hoist cylinder 46 causes the pair of upright assemblies 44 and hence, the lift platform member 24 to be drawn upward with the cross-head member 56. The extending of the inner upright assembly 44 also causes the boot strap chains 60 to lift the intermediate upright assembly 42 upwardly. In this case, the speed of the extending intermediate upright assembly 42 is approxim;ately half that of the inner upright assembly 44. This condition of the mast extension continues until the mast is fully extended. Accordingly, the lowering of the mast is a reversal of its extension. In the free-lift condition as illustrated in FIG. 10, when the hoist cylinder 46 is powered from the fully lowered position of FIG. 8, the lift platform member 24 is drawn upward within the inner upright assembly 44 at a speed approximately twice that of the hoist cylinder 46. The free-lift portion of the extending sequence ends when the cross head lifting member 56 contacts the upper cross member 59 of the inner upright assembly 44. Accordingly, the fully lowered position of the mast assembly of FIG. 10 corresponds to that illustrated in FIG. 1 and the fully extended position of the mast assembly of FIG. 9 corresponds to that illustrated in FIG. 3. The free-lift position of the mast assembly of FIG. 10 corresponds to that illustrated in FIG. 2 wherein the lift platform member 24 is raised upwardly upon extension of the hoist cylinder 46, as aforesaid.

Figure 11:
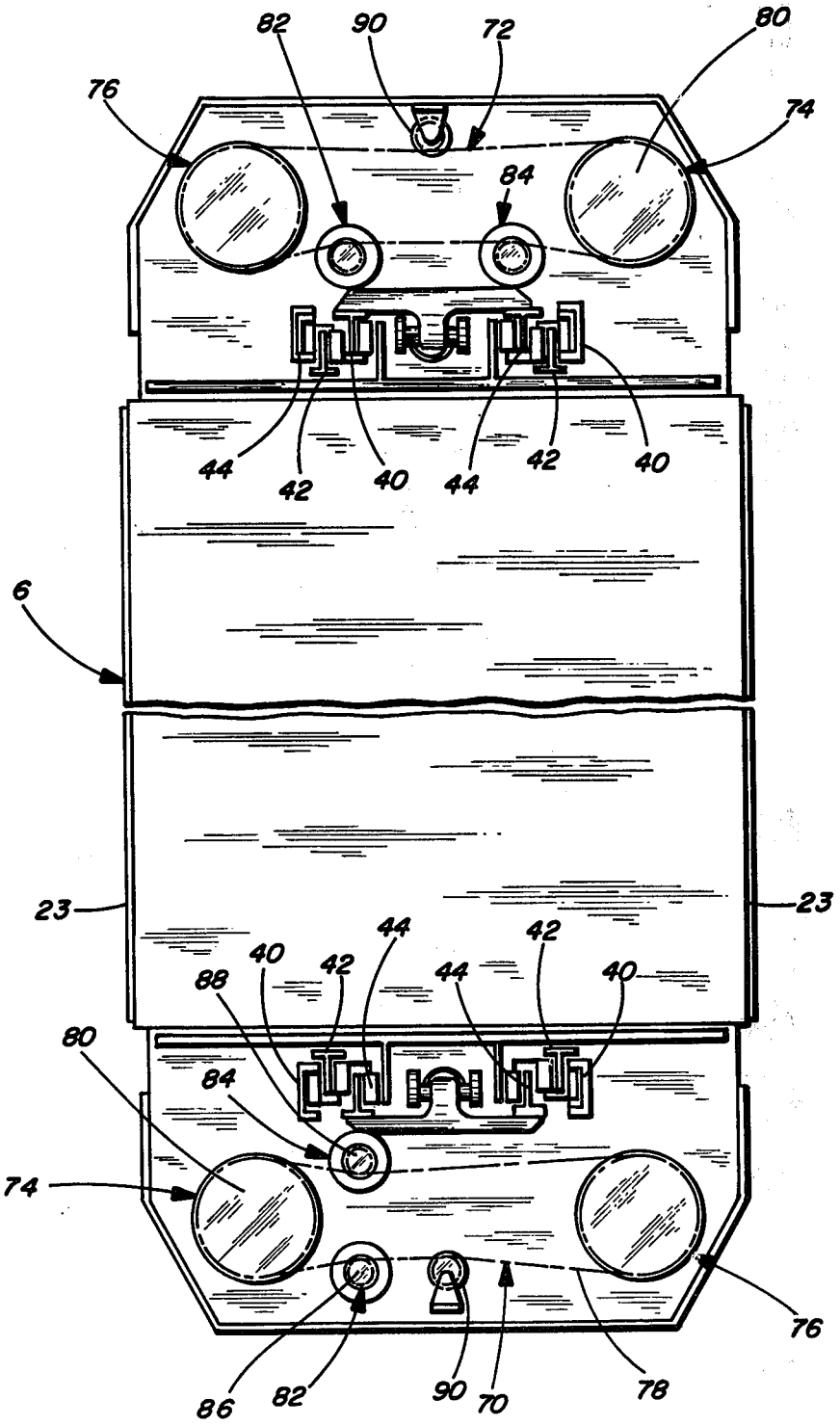
FIG. 11 is a diagramatic top plan view of the lift apparatus illustrating the chain-drive for synchronously steering the front and rear wheels of the apparatus.

As best illustrated in FIG. 11, the wheels of the vehicle are controlled by a novel steering system in accordance with the invention. As shown, this system includes a front steering assembly 70 and a rear steering assembly 72. The front steering assembly 70 includes a front driving wheel mechanism 74 and a caster wheel mechanism 76 interconnected for synchronous turning movement by means of a drive chain 78. The drive mechanism 74 is of a steering and traction type which is commercially available from the Eaton Corporation and is described in U.S. Pat. Nos. 2,842,216; 2,899,223; and 2,929,460. In this case, the mechanism includes a hydraulically power driven traction wheel W that is hydraulically driven for moving the vehicle along the ground. Mechanism 74 further includes an integral sprocket 80 which drivingly meshes with the chain 78 for driving the caster mechanism 76 which, in turn, includes a freely rotatable caster wheel W'. The drive chain 78 is engaged, in this embodiment, by a pair of oppositely disposed hydraulically actuated orbital drive units 82 and 84 mounted on the chassis each of which includes sprocket drive members 86 and 88 for meshing with the drive chain 78 so as to drive the caster wheel W' synchronously with the traction wheel W' upon actuation of the orbital drive units for turning the wheels from 0° through 90° in either direction, as desired. The hydraulic orbital drive units 82 and 84 are of the type described in applicants co-pending application Ser. No. 299,052 and are commercially available from the Char-Lynn Company under Model Number 103-1007-007, Series S. The hydraulic orbital units 82 and 84 are controllable from the operator's cab 30 in accordance with the steering control system, as will hereinafter be more fully described. A chain tensioning sheave, as at 90, may be provided to maintain the desired drive tension on the chain 78.

The rear steering system 72 is substantially identical to the front system 90 such that like reference numerals designate like parts throughout. In this case, however, the rear hydraulic drive wheel unit mechanism 74 is disposed diagonally opposite that of the front mechanism and hence, the rear caster wheel mechanism 76 is disposed diagonally opposite that of the front caster wheel mechanism. Also, the hydraulic orbital steering drive units 82 and 84 are laterally spaced apart on opposite sides of the longitudinal central axis of the vehicle, whereas, there spaced in side by side relation on one side of the longitudinal axis for the front wheels. By this arrangement, actuation of either the front or rear wheel drive unit 74, or by simultaneously driving both, the vehicle can be effectively turned from 0° through 90° in either direction or in opposite directions for turning to 360°. Alternatively, the vehicle can be steered from the front or back by the drive wheel unit 74 since the caster wheels W' are free to rotate and hence follow, turning movement of the drive wheel units. Accordingly, actuation of the hydraulic orbital units 82 and 84 may drive the chains 78 in clockwise or counterclockwise directions to accomplish the desired synchronous movement of the front and back wheels. It is to be understood, however, that the front wheels could both be in the form of the freely rotatable caster wheels, whereas, both rear wheels could embody the self-propelled drive wheel units 74 and vice versa to enable the vehicle to be driven solely from either the front or the back, as desired.

Figure 12:
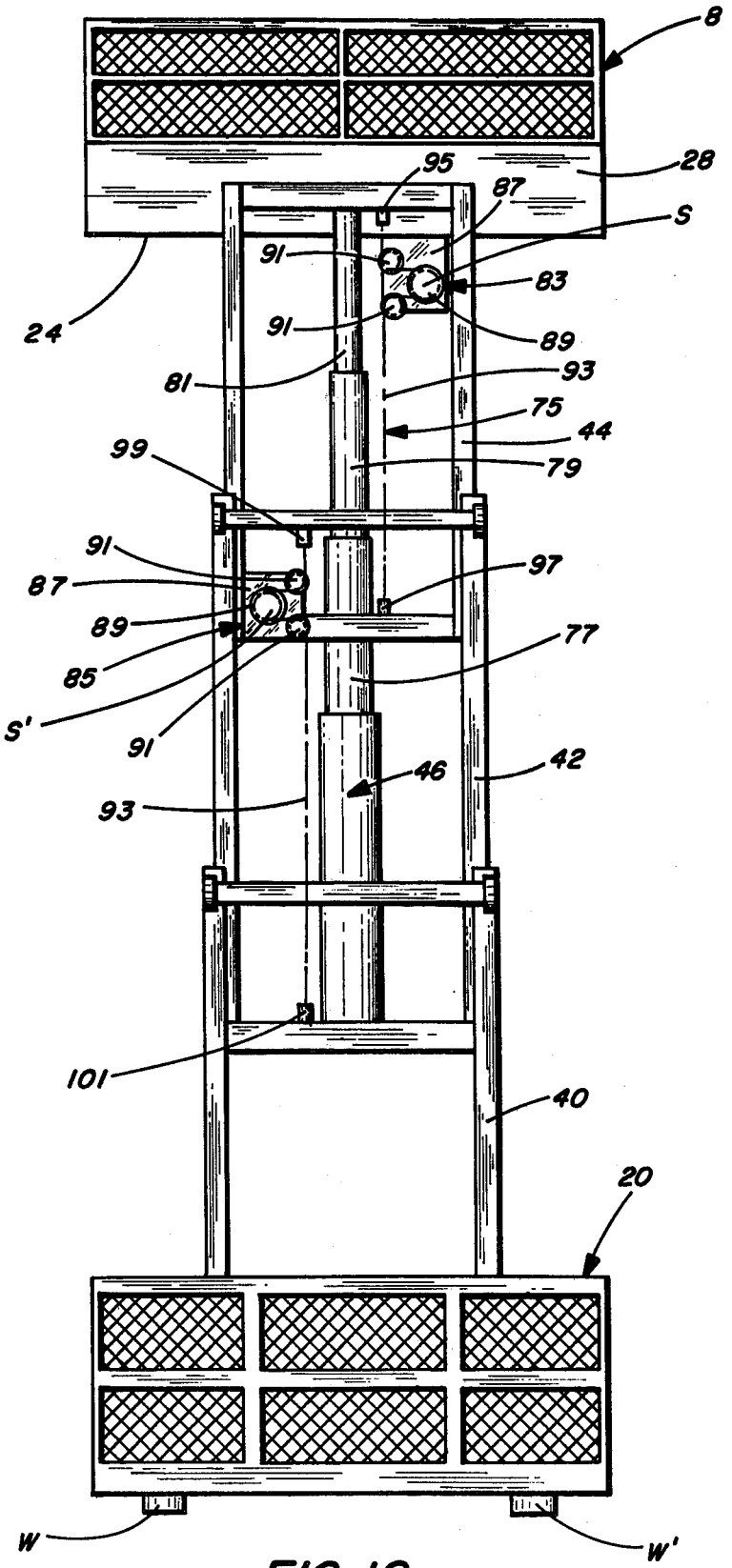
FIG. 12 is a fragmentary diagramatic illustration showing the lift platform stabilizing assembly in accordance with the invention.
Figure 13:
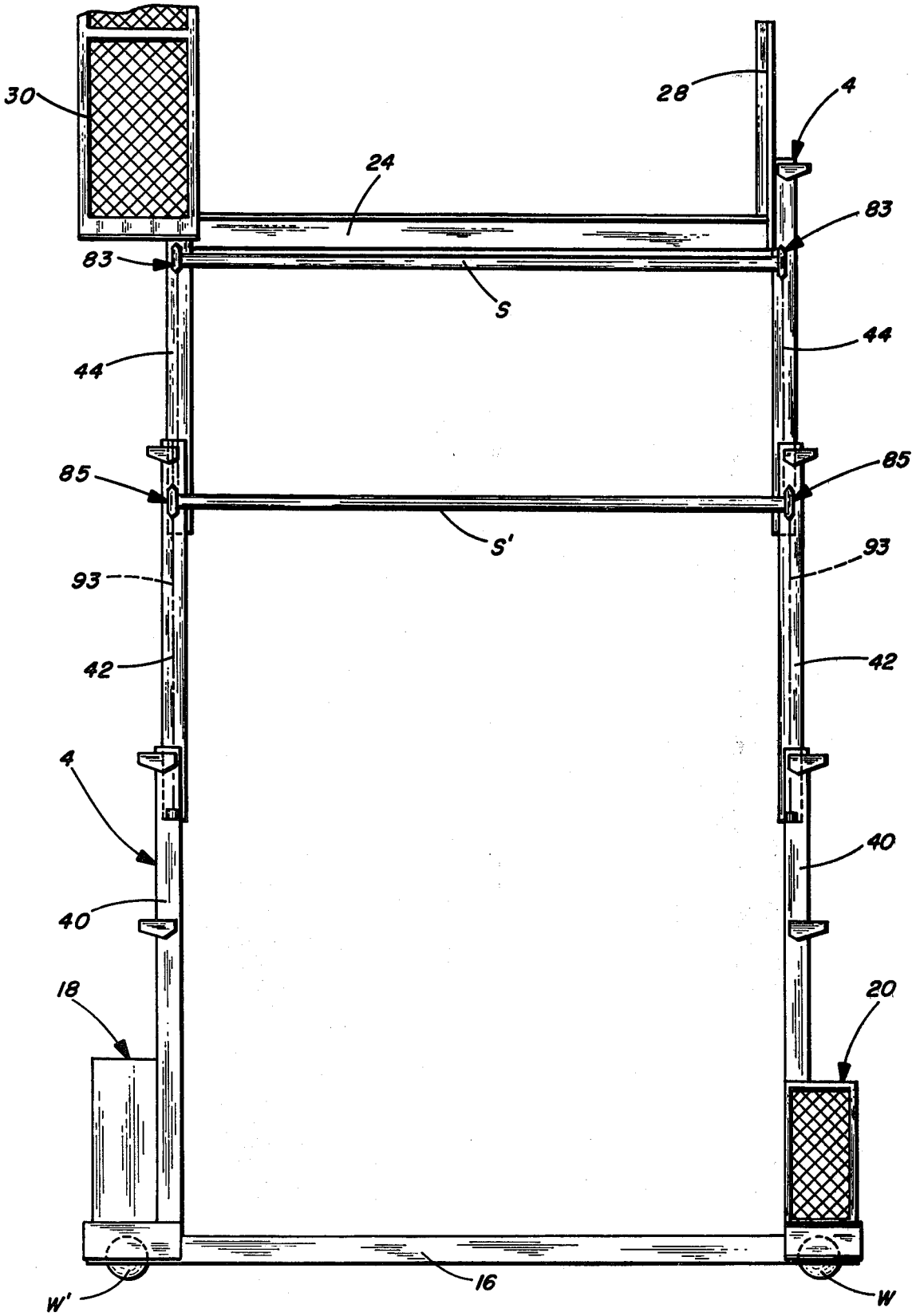
FIG. 13 is a fragmentary, side elevation view of the lift platform stabilizing assembly of FIG. 12.

Referring to FIGS. 12 and 13 of the drawings, there is illustrated a torque bar stabilizing system, designated generally at 75, for automatically maintaining the lift carriage 8 in a balanced and level condition during and raising and lowering thereof. As shown, this system is operably associated with the hydraulic cylinder 46 which includes a master plunger 77, a primary plunger 79 and a slave plunger 81. In operation, when the mast assemblies 4 are actuated from the fully lowered position, as illustrated in FIGS. 1 and 8, the primary plunger 79 should extend from within the master plunger 77 to the end of its stroke. Then the master 77 and slave plungers 81 should extend simultaneously to the end of their strokes. The lowering of the plungers is a reversal of the extension. In this case, the master plunger 77 extends at half the speed that the primary plunger 79 extended. However, since the master and slave plungers extend simultaneously at the same speed, the combined speed of the master and slave plungers equals the speed of the primary plunger. As a result the cylinder assembly extends (and lowers) at a constant speed through its complete sequence of operation. Such plunger assembly is commercially available from the Cascade Corporation, Portland, Ore. By this arrangement, there are provided a triple-stage mast assemblies 4 disposed in laterally spaced, opposed sides of the lift carriage 8.

Now in the invention, the stabilizing assembly 75 includes an upper torque bar assembly 83 and a lower torque bar assembly 85 which are structurally of identical construction and hence, like reference characters designate like parts throughout. The upper assembly, for example, includes a pair of oppositely disposed support plates 87 fixedly attached to the underside of the bottom or base 24 of the carriage lift assembly 8. An elongated torsion bar S is journalled for rotation within the plates 87. The opposed ends of the bar S each mount a sprocket wheel which rotates with the bar. Each plate 87 mounts a pair of idler sprockets 91 which are journalled for free rotation in the plates 87. A guide chain 93 is fixedly attached, as at 95, to the upper end of the inner mast assembly 44 and at its other end, as at 97, to the lower end thereof. By this arrangement, the chain 93 acts as a guide since the chain is looped around the rotatable sprockets 89 and 90 so that the torsion bar S rides up and down immediately beneath and with the lift carriage assembly 8 to maintain a predetermined leveling action thereon. The lower stabilizing assembly 85 is of an identical construction except that the guide chain 93 is fixedly attached, as at 99, to the upper end of the intermediate mast assembly and at its lower end, as at 101, to the lower end of the intermediate mast assembly 42. Accordingly, as the cylinder 46 is hydraulically extended from the lower most position illustrated in FIGS. 1 and 8, the lower torsion bar S', guided by the chain 93, initially acts to balance the lift carriage and after the carriage has been raised beyond the point illustrated in FIG. 2, the upper torsion bar S, being fixedly attached to the lift carriage assembly 8 and to the inner mast assembly 44, acts to level the lift carriage until the same has reached its fully extended position, as illustrated in FIGS. 12 and 13. The lowering of the lift carriage is a reversal of the extension of the cylinder via the triple-stage mast assemblies 4. As illustrated in FIG. 13, it will be seen that a guide chain 93 is associated with each mast assembly 4 for guiding upward and downward movement of the torsion bars S and S'.

Figure 14:
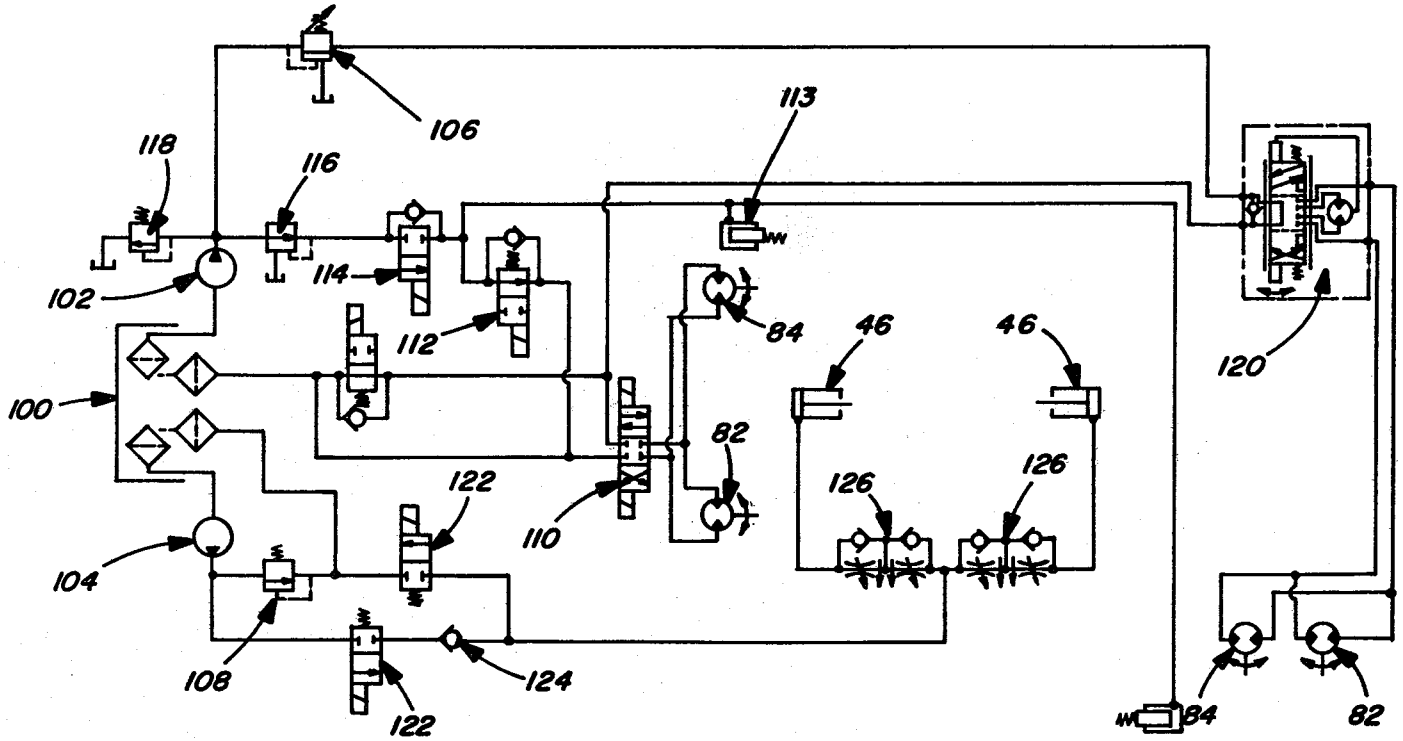
FIG. 14 is a diagramatic illustrating showing one form of the hydraulic control system for controlling the steering movement of the wheels and for the lift apparatus in accordance with the invention.

Now referring to FIG. 14 of the drawings, there is illustrated one form of a hydraulic control system for controlling steering of the apparatus. As shown, the system includes a hydraulic supply reservoir 100, a power steering pump 102, a hydraulic lift pump 104, a steering pressure control valve 106 and a lift pressure control valve 108.

In accordance with the invention, to provide manual (automotive steering), there is provided the hydraulic steering control unit 120 which is commercially available from the Char-Lynn Company and disclosed in Reissue U.S. Pat. No. Re. 25,126. This valve directly controls the steering to the front wheels via hydraulic orbital drive units 82 and 84. As in applicant's copending application Ser. No. 299,052, the hydraulic orbital motors 82 and 84 act to turn the front wheels via the interconnecting chain drive assemblies 70 and 72 from 0° through 90° in either direction. The rear wheel is controlled by electric solenoid valve 110 which actuates the front hydraulic orbital motors 82 and 84. As previously noted, the rear orbital motors 82 and 84 are located on one side of the platform chassis, whereas, the front orbital motors 82 and 84 are located on opposite sides of the platform chassis, as illustrated in FIG. 11. The rear steering is controlled by suitable switches (not shown) located in the operator's cab 30.

In the invention, for manual (automotive steering) the hydraulic valve unit 120 is actuated by the joy stick 32 located in the operator's cab 30. Actuation of the valve 120 actuates the front hydraulic orbital steering motors 82 and 84 to provide steering from 0° through 90° in either direction and in synchronization via the chain drive, as aforesaid. For rear steering, electronic solenoid valve 110 is energized which actuates the rear hydraulic orbital motors 82 and 84 which then drive the wheels synchronously in the same direction from 0° through 90°. Accordingly, in the embodiment illustrated the front wheels are constructed and arranged for manual (automotive) steering while the rear wheels are constructed to turn fully from 0° to 90° to enable the vehicle to move directly out of one aisle and then move transversely at right angles to the next aisle, without turning movement of the chassis, and then move at right angles down the next adjacent aisle. Hence, in this embodiment, the vehicle can move quickly and easily from aisle to aisle in a typical warehouse operation with little, if any, need to turn the chassis of the vehicle itself.

Now in the invention, the dual mast, triple-lift system utilizes a hydraulic pump 112 actuated by a suitable electric motor. Another hydraulic pump 102 is provided as the fluid pressure source for the hydraulic steering system. A pressure relief valve 108 is operably connected with the pump 104 and with a pair of electric solenoid valves 122 with one of said valves being energized for raising the lift carriage 8 and the other for lowering the same. The electric solenoid valves 122 are again actuated from suitable switches (not shown) located in the operator's cab 30. A check valve 124 is provided to insure a predetermined holding pressure to prevent lowering of the lift carriage 8 by preventing loss of fluid pressure from the electric solenoid control valves 122. Fluid pressure from the solenoid valves 122 are supplied to a pair of two-way flow control valves 126. These control valves 126 control the hydraulic cylinders 46 which raise and lower the triple-stage mast assemblies. Accordingly, in the invention the valves 126 act in a balance condition so as to maintain the lift carriage assembly 8 in a level or horizontal position during the raising and lower thereof. Accordingly, in the invention there is provided a hydraulic and mechanical arrangement for maintaining the lift carriage assembly 8 in a level condition during normal usage thereof.

In the invention, solenoid control valves 112, 14, 116 and 118 act to actuate a hydraulic braking system for automatically releasing the brakes (not shown) on each of the four wheels upon actuation of a suitable power switch (not shown) utilized for starting the vehicle. In the non-operating position, the brakes are maintained in a locked position by means of a spring-loaded brake mechanism (not shown). Accordingly, actuation of a pressure relief valve 113 automatically releases the braking force on the wheels upon starting of the vehicle. This provides a safety feature to prevent the vehicle from moving inadvertently when not in use. In addition, the system automatically stops the vehicle should the operator for any reason become impaired or fall off the vehicle.

The preferred embodiments of the invention have been illustrated in a diagramatic form since on the basis thereof the finished products may be achieved by any person skilled in the art.

I claim:

1. A lift apparatus for use in material handling comprising a chassis member mounted on wheel means for movement along the ground, a pair of laterally spaced, oppositely disposed mast assemblies extend upwardly from said chassis member, a lift platform assembly is disposed between and operably connected to said mast assemblies for vertical lifting movement toward and away from said chassis member, and fluid power means are operably associated with each of said mast assemblies to impart said lifting movement to said lift carriage assembly, wherein said wheel means includes a pair of steering and traction units each including a motor and a steering and traction wheel, and a pair of freely rotatable caster wheels, endless chain drive means operably connecting one of said caster wheels with an associated one of said steering and traction units for synchronously turning said caster wheels upon actuation of an associated of said motors, and an operators cab mounted for movement with said lift carriage assembly, and steering control means operable from said operator's cab for controlling steering movement of said steering and traction units from said cab, wherein said steering and traction units each include driven sprocket means disposed for meshing engagement with said drive chain means and said orbital drive motors including drive sprocket means for driving meshing engagement with said drive chain means for synchronously turning said caster wheels with said traction wheels.

2. A lift apparatus for use in material handling comprising a chassis member mounted on wheel means for movement along the ground, a pair of laterally spaced, oppositely disposed mast assemblies extend upwardly from said chassis member, a lift platform assembly is disposed between and operably connected to said mast assemblies for vertical lifting movement toward and away from said chassis member, and fluid power means are operably associated with each of said mast assemblies to impart said lifting movement to said lift carriage assembly, wherein said wheel means comprise a pair of diagonally oppositely disposed steering and traction units each comprising a motor and a steering and tractional wheel, and a pair of caster wheels diagonally oppositely disposed on said chassis member, and wherein a chain drive means operably connects each of said steering and traction units to one of said caster wheels for turning said caster wheel in synchronization with said traction wheel upon actuation of said motor.

3. A lift apparatus in accordance with claim 2, including stabilization torsion bar means operably associated with said mast assemblies and said carrige lift assembly for maintaining said carriage lift assembly in a substantially horizontal position upon raising and lowering movement thereof.

4. A lift apparatus in accordance with claim 2, wherein said mast assemblies each include an outer mast assembly, an intermediate mast assembly disposed for telescopic movement in said outer mast assembly and an inner mast assembly telescopically movable in said intermediate mast assembly, said outer mast assembly being fixedly mounted on said chassis member and said inner mast assembly being fixedly connected to said lift carriage assembly.

5. A lift apparatus in accordance with claim 4, wherein a multi-stage hydraulic cylinder means is mounted for movement on and with said intermediate mast assembly, first chain lift means fixedly connected at its opposite ends to said outer and inner mast assemblies and drivingly connected intermediate its ends to said intermediate mast assembly, and second lift chain means fixedly attached as its opposed ends to said inner mast assembly and intermediate its ends being drivingly connected to an outermost plunger of said cylinder means for raising and lowering said intermediate and inner mast assemblies upon actuation of said cylinder means.

* * * * *